US007677483B2

(12) United States Patent
Romanovich et al.

(10) Patent No.: US 7,677,483 B2
(45) Date of Patent: Mar. 16, 2010

(54) SUBSTRATE DESTRUCTION APPARATUS WITH SHARED ROTATING SHAFT

(75) Inventors: Dmitry Romanovich, Glen Ellyn, IL (US); Vadim Romanovich, Glen Ellyn, IL (US)

(73) Assignee: Fellowes, Inc., Itasca, IL (US)

( * ) Notice: Subject to any disclaimer, the term of this patent is extended or adjusted under 35 U.S.C. 154(b) by 409 days.

(21) Appl. No.: 11/696,576

(22) Filed: Apr. 4, 2007

(65) Prior Publication Data

US 2008/0245908 A1 Oct. 9, 2008

(51) Int. Cl.
*B02C 18/08* (2006.01)

(52) U.S. Cl. ..... 241/100; 241/236; 241/243

(58) Field of Classification Search ..... 241/100, 241/236, 243, 139

See application file for complete search history.

(56) References Cited

U.S. PATENT DOCUMENTS 5,639,035 A * 6/1997 Maugle et al. ..... 241/236
5,954,569 A 9/1999 Hutchison
6,065,696 A * 5/2000 Tsai ..... 241/37.5
6,189,446 B1 2/2001 Olliges
6,334,582 B1 1/2002 Castronovo
6,550,701 B1 4/2003 Chang
6,585,177 B2 7/2003 Castronovo
6,588,687 B2 7/2003 Castronovo
6,676,050 B2 1/2004 Chang
6,679,444 B2 1/2004 Castronovo
6,685,119 B2 2/2004 Castronovo
6,742,733 B2 6/2004 Huang
6,758,392 B2 7/2004 Bennett (Continued)

FOREIGN PATENT DOCUMENTS

CN 2693343 4/2005

(Continued)

OTHER PUBLICATIONS

International Search Report and Written Opinion of the International Searching Authority issued in related application PCT/US2008/058136, Jul. 31, 2008, 12 pages.

(Continued)

*Primary Examiner*—Faye Francis
(74) *Attorney, Agent, or Firm*—Pillsbury Winthrop Shaw Pittman LLP

(57) ABSTRACT

A substrate destruction apparatus for destruction of paper and optical discs, wherein first and second shafts are used for shredding paper fed through a paper receiving opening and second shaft is shared such that the second shaft and a stationary structure are used to damage optical discs. First and second shafts are provided with a plurality of cutter elements that interleave with when rotated relative to each other during use in a paper mode. When the apparatus is operated in a disc destruction mode, the shared second shaft is rotated in an opposite direction than the paper shredding direction and interleaves with the stationary structure to at least damage an optical disc fed through the disc receiving opening. Cutting elements on the second shaft have radial projections and protrusions for damaging at least the surface of the disc with a plurality of scratches, depressions, or cuts, rendering the disc unreadable.

22 Claims, 6 Drawing Sheets

U.S. PATENT DOCUMENTS

| | | | | |
|---|---|---|---|---|
| 6,763,997 | B2 | 7/2004 | Bennett | |
| 6,910,650 | B1 | 6/2005 | Siegelman | |
| 6,929,535 | B2 | 8/2005 | Smith | |
| 2003/0006330 | A1 | 1/2003 | Chang | |
| 2003/0116664 | A1 * | 6/2003 | Castronovo | 241/185.5 |
| 2006/0038048 | A1 * | 2/2006 | Lo | 241/100 |
| 2006/0086224 | A1 | 4/2006 | Lo | |

FOREIGN PATENT DOCUMENTS

| | | |
|---|---|---|
| DE | 199 37 735 | 2/2001 |

OTHER PUBLICATIONS

International Preliminary Report on Patentability for PCT International Application No. PCT/US2008/058136, mailed on Oct. 6, 2009.

* cited by examiner

SUBSTRATE DESTRUCTION APPARATUS WITH SHARED ROTATING SHAFT

BACKGROUND OF THE INVENTION

1. Field of Invention

The present invention is generally related to an apparatus having cutter elements for destroying a plurality of articles such as paper and discs. In particular, the apparatus comprises a shaft that is shared and rotated in one direction for destroying paper and rotated in another direction for destroying discs.

2. Background

The use of shredders is well-known for shredding items such as documents and papers, discs such as CDs, DVDs, etc.

A common type of shredder has a shredder mechanism contained within a housing that is removably mounted atop a container. The shredder mechanism typically has a series of cutter elements that shred articles such as paper and documents fed therein and discharges the shredded articles downwardly into the container. Because CDs and DVDs are often used to store the same type of information as paper, it logically follows that businesses would want to destroy CDs and DVDs containing confidential information, and make them unreadable. Thus, some shredders have been used for shredding both paper and discs (e.g., see U.S. Pat. No. 6,550,701 B1). CDs and DVDs, however, are generally disc-shaped structures that are rigid, or at least semi-rigid, and the cutting elements typically used in shredders for cutting paper may not be well-suited for effectively destroying such objects.

In one approach, the prior art relies on the addition of a separate shaft with cutter elements to destroy discs. A rotatable first and second shaft are provided in a shredder. A third shaft is then added to the shredder. The first and second shafts are rotated and used together as a pair when there is a need to destroy paper. The second and third shafts are rotated and used together as a pair when there is a need to destroy discs. However, the use of a third shaft in a shredder is cumbersome and not cost-effective. The addition of the shaft requires more parts, assembly time and money per shredder. The materials used for the shaft or cutting elements must be strong and durable. Also, the rotating shafts that are used to shred a disc into multiple pieces require a large amount of torque and power to shred the disc. Examples of such prior art approaches are shown in U.S. Pat. No. 6,676,050 B2, U.S. Patent Application Publication 2006/10086224 A1, German Patent 19937735 A1, and Chinese Patent 2693343 Y.

SUMMARY OF THE INVENTION

One aspect of the invention provides a substrate destruction apparatus for destruction of at least paper and optical discs comprising a housing with a paper receiving opening and a disc receiving opening in a spaced apart relation from each other. The substrate destruction mechanism comprises first and second rotatable shafts with a plurality of cutter elements that interleave with each other. The shafts and cutter elements are positioned such that paper fed through the paper receiving opening of the housing is fed between the shafts and the cutter elements. The substrate destruction mechanism also comprises an electrically powered motor for rotating the shafts in a paper shredding direction wherein the cutter elements shred the paper fed through the paper receiving opening. The substrate destruction mechanism further comprises a stationary structure having an array of engaging members with spaces therebetween, wherein at least a portion of the cutter elements on the second shaft have radial projections thereon, the stationary structure and the second shaft being arranged such that at least the radial projections are received in spaces on the stationary structure. The radial projections are designed to interleave with the engaging members such that when an optical disc is fed through the disc receiving opening, it is fed between at least a portion of the cutter elements of the second shaft and the stationary structure. The motor also rotates the second shaft in a disc destruction direction opposite the paper shredding direction, thus at least damaging an optical disc fed through the disc receiving opening between the radial projections and the engaging members.

The motor is operable in a paper mode to rotate the shafts in the paper shredding direction, and is operable in a disc destruction mode to rotate the second shaft in the disc destruction direction. The disc destruction mode is preferably the reverse of the paper mode.

The cutter elements preferably, but not necessarily, include cross-cut teeth for cross-cutting paper fed between the shafts and the cutter elements during rotation of the shafts in the paper cutting direction. The radial projections on the cutter elements of the second shaft preferably include the cross-cut teeth. The radial projections may also include protrusions positioned circumferentially between the cross-cut teeth of the cutter elements, and the protrusions may have a lesser radial extent than the cross-cut teeth.

The damage to an optical disc preferably comprises scratches, cuts, depressions, holes, punches, or shredding into pieces. The damage may be caused by the cross-cut teeth and protrusions. The damage may also be of different depths along the disc surface.

The operation of the motor may optionally be determined upon detection of a substrate in the paper receiving or disc receiving opening. To detect the substrate, a sensor or device such as an optical sensor may be provided in the paper receiving opening and in the disc receiving opening. Alternatively, operation of the motor may be determined upon activation of an on/off switch. The switch may be movable from an off position to a paper position or a disc position, wherein when the switch is placed in the paper mode position the motor is operable in the paper mode, and when the switch is placed in the disc mode position the motor is operable in the disc destruction mode.

Another aspect of the invention provides a method for the destruction of substrates including paper and optical discs comprising: inserting a substrate through a paper receiving opening or a disc receiving opening provided on a housing; determining whether the substrate has been inserted into the paper receiving opening or the disc receiving opening; and, based on the determination, (a) if the substrate has been inserted into the paper receiving opening, rotating a first and second rotatable shafts in a paper shredding direction with a motor such that cutter elements provided on the first shaft interleave with the cutter elements provided on the second shaft to shred the substrate fed through the paper receiving opening; or (b) if the substrate has been inserted into the disc receiving opening, rotating the second rotatable shaft in a disc destruction direction with a motor opposite the paper shredding direction such that the cutter elements on the second shaft interleave with engaging members on a stationary structure, thus at least damaging the substrate fed through the disc receiving opening. The method may also comprise: (a) if the substrate has been inserted into the paper receiving opening, the motor is operated in a paper mode to rotate the shafts in the paper shredding direction; or (b) if the substrate has been inserted into the disc receiving opening, the motor is operated in a disc destruction mode to rotate the second shaft in the disc destruction direction, the disc destruction mode being the reverse of the paper mode.

The method may further comprise sensing insertion of the substrate in the paper receiving opening or in the disc receiving opening. The method may also comprise using radial projections on the cutter elements located on the second shaft to destroy the substrate.

In another aspect of the invention, a substrate destruction apparatus comprises a housing with a substrate destruction mechanism, an electrically powered motor, cutter elements, and a stationary structure. The destruction mechanism enables an optical disc to be fed into a disc receiving path located between the cutter elements and the stationary structure, and the motor is operable to drive the cutter elements in a disc destruction direction so that the cutter elements and stationary structure at least damage the disc fed in the disc receiving path. The housing preferably has a disc receiving opening for enabling the optical disc to be fed there through into contact with the cutter elements and the stationary structure of the substrate destruction mechanism for at least damaging the disc. A waste container may be disposed beneath the substrate destruction mechanism. The waste container is configured to receive the at least damaged discs from the substrate destruction mechanism. The waste bin may be manually removable from beneath the document shredder mechanism for emptying of the destroyed substrates therein. A paper receiving opening for enabling paper to be fed there through and in contact with the cutter elements for shredding the paper may also be provided. The disc receiving opening and the paper receiving opening are provided in a spaced apart relation and parallel to each other.

Other objects, features, and advantages of the present invention will become apparent from the following detailed description, the accompanying drawings, and the appended claims.

DETAILED DESCRIPTION OF THE PREFERRED EMBODIMENT(S) OF THE INVENTION

Figure 1:
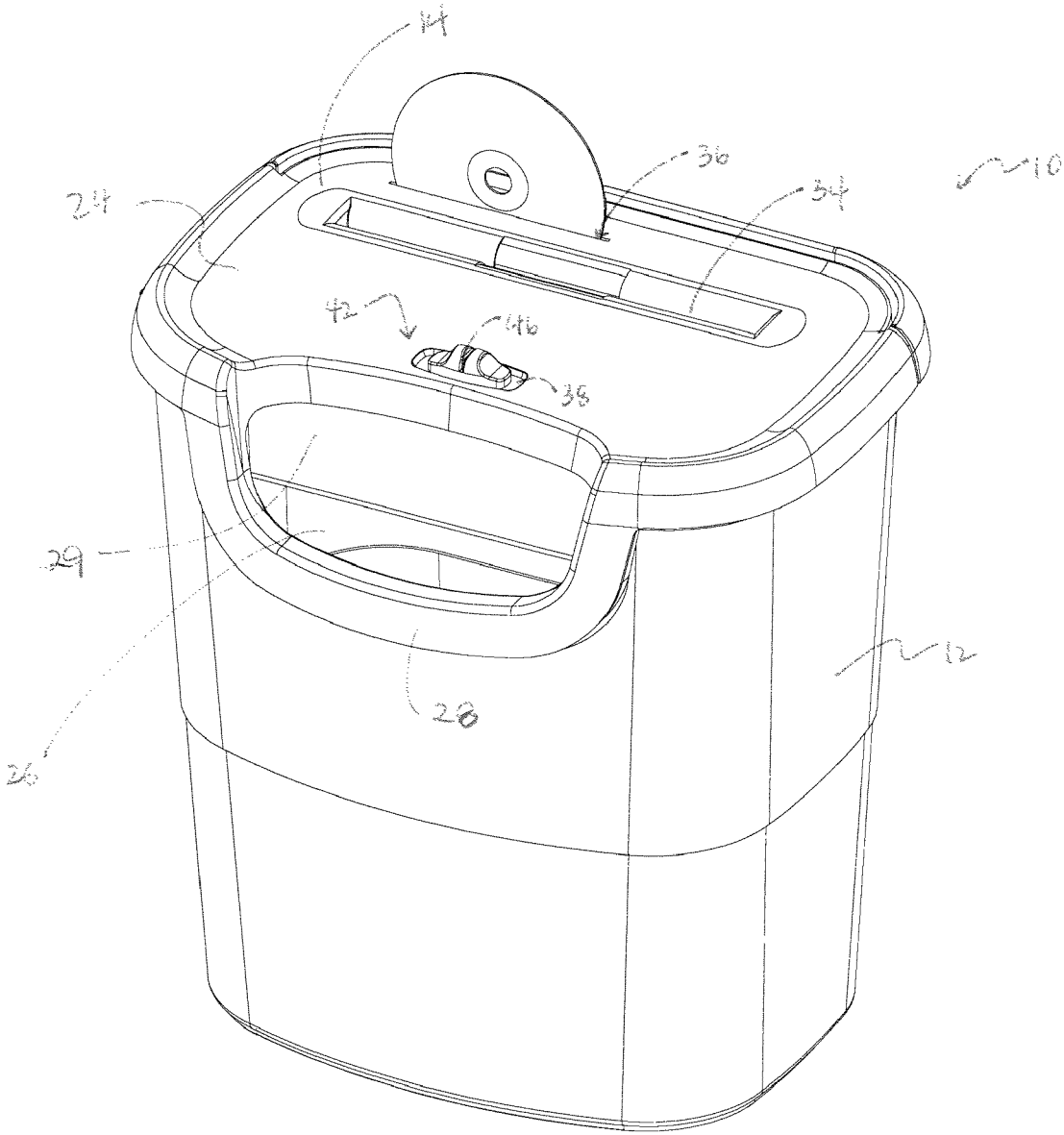
FIG. 1 is a perspective view of a substrate destruction apparatus in accordance with a preferred embodiment of the present invention.
Figure 2:
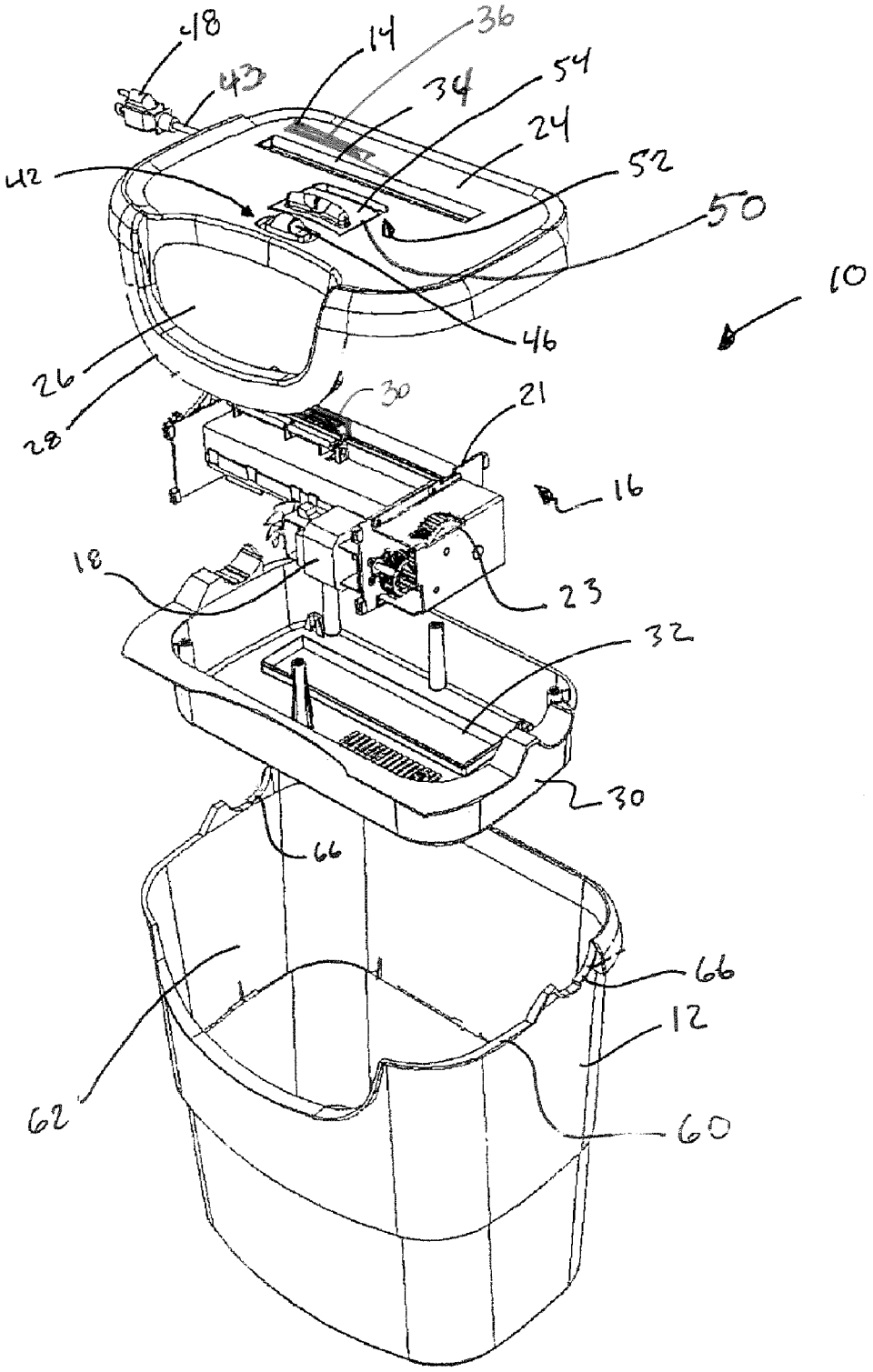
FIG. 2 is an exploded perspective view of the substrate destruction apparatus of FIG. 1.

FIGS. 1-2 illustrate a substrate destruction apparatus in accordance with a preferred embodiment of the present invention. The substrate destruction apparatus is generally indicated at 10 and is designed to destroy multiple articles such as paper and discs. Apparatus 10 sits on top of container 12, which is preferably a waste container or waste bin. Preferably, apparatus 10 comprises housing 14 that sits on the upper periphery of container 12 in a nested relation. However, apparatus 10 may be of the type provided with an adaptable mount for attachment to a wide variety of containers. Generally speaking, apparatus 10 may have any suitable construction or configuration and the illustrated embodiment is not intended to be limiting in any way. For example, the present invention may be incorporated into Model 480, 480CC and 480HS Powershred® shredders available from Fellowes, Inc., of Itasca, Ill., or any other type of shredder.

Figure 3:
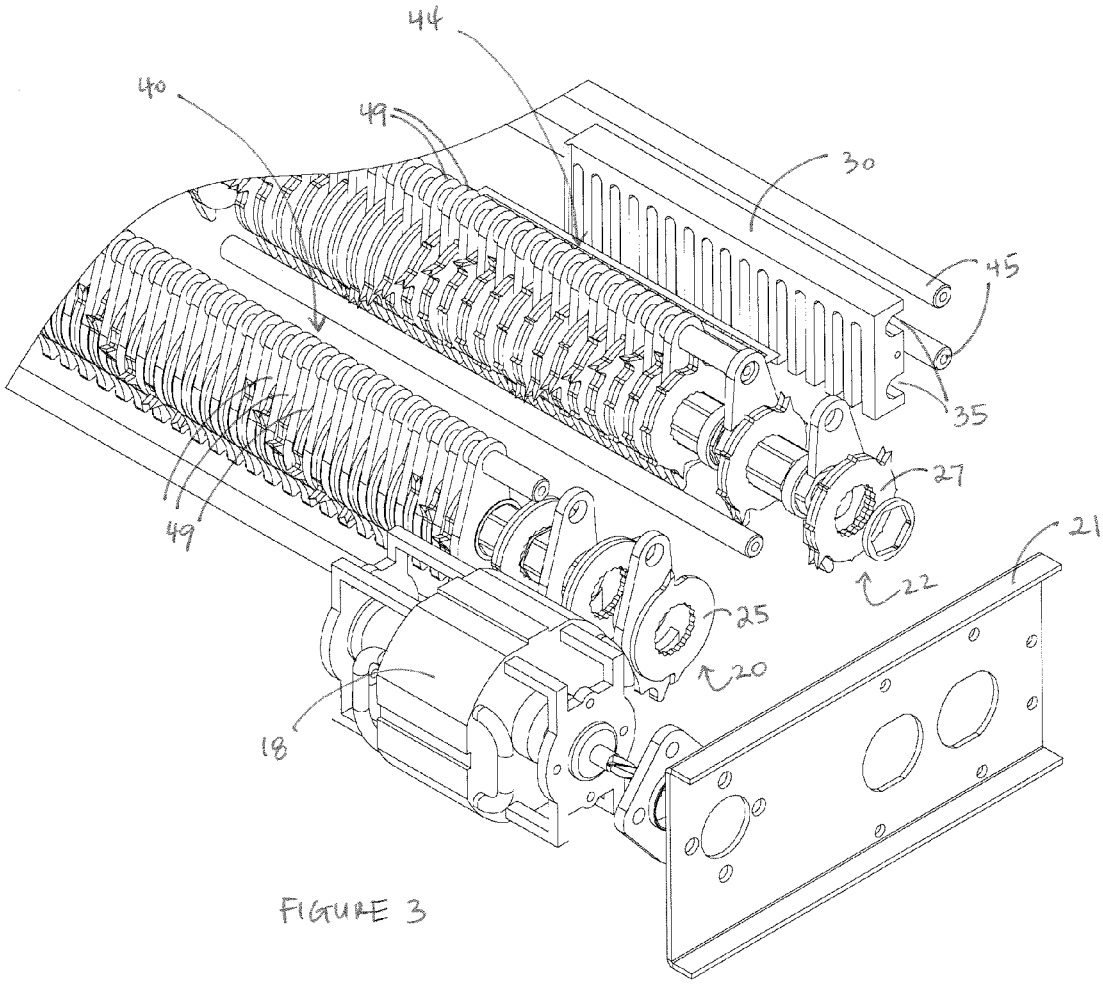
FIG. 3 shows a detailed, perspective view of first and second rotatable shafts and a stationary structure in accordance with the preferred embodiment of the present invention.

Apparatus 10 comprises substrate destruction mechanism 16 in housing 14, and includes a drive system with at least one motor, such as electrically powered motor 18, and a plurality of cutter elements 25 and 27 (further described with reference to FIGS. 3-5 below). Motor 18 operates using electrical power to rotatably drive first and second rotatable shafts 20 and 22 and their corresponding cutter elements 25 and 27 through a conventional transmission 23 so that the cutter elements shred or destroy articles fed therein. In the illustrated embodiment only one motor is shown; however, the drive system may have any number of motors, and may include one or more transmissions. A plurality of cutter elements 25, 27 are mounted on first and second rotatable shafts 20 and 22 in any suitable manner, and a preferred embodiment of the shafts 20 and 22 with cutter elements is illustrated in FIG. 3. Substrate destruction mechanism 16 also may include sub-frame 21 for mounting the shafts 22, motor 18, and transmission 23, for example.

Apparatus 10 also comprises housing 14, as noted above. Housing 14 includes top wall 24 that sits atop container 12. Top wall 24 is preferably molded from plastic and has opening 26 near the front thereof. Opening 26 is formed in part by a downwardly depending generally U-shaped member 28. Opening 26 allows waste to be discarded into container 12 without being passed through substrate destruction mechanism 16. Member 28 may act as a handle for carrying apparatus 10 separate from container 12. As an optional feature, opening 26 may be provided with a lid, such as a pivoting lid, that opens and closes opening 26. However, this opening is general is optional and may be omitted entirely. Moreover, housing 14 and its top wall 24 may have any suitable construction or configuration.

Housing 14 may include bottom receptacle 29 having a bottom wall, four side walls, and an open top. Substrate destruction mechanism 16 is received therein, and receptacle 29 is affixed to the underside of top wall 24. Receptacle 29 may be fixed to the underside of top wall 24 by fasteners, for example. Receptacle 29 preferably has a downwardly facing opening 32 for permitting destroyed articles to be discharged from substrate destruction mechanism 16 into container 12.

Top wall 24 has switch recess 38 with an opening (not shown) there through. An on/off switch 42 includes a switch module (not shown) mounted to the top wall 24 underneath the recess 38 by fasteners, and a manually engageable portion 46 that moves laterally within the recess 38. The switch module may have a movable element (not shown) that connects to the manually engageable portion 46 through the opening. This enables movement of the manually engageable portion 46 to move the switch module between its states.

The switch module connects the motor 18 to the power supply (not shown). Typically, the power supply will be a standard power cord 43 with a plug 48 on its end that plugs into a standard AC outlet, but any suitable manner of power delivery may be used. The switch 42 is movable between an on position and an off position by moving the portion 46 laterally within the recess 38. In the on position, contacts in the switch module are closed by movement of the manually engageable portion 46 and the movable element to enable a delivery of electrical power to the motor 18. In the off position, contacts in the switch module are opened to disable the delivery of electric power to the motor 18.

As an option, the switch 42 may also have a reverse position wherein contacts are closed to enable delivery of electrical power to operate the motor 18 in a reverse manner. This would be done by using a reversible motor and applying a current that is of a reverse polarity relative to the on position. The capability to operate the motor 18 in a reversing manner is desirable to move the cutter elements, such as those on the first rotating shaft, in a reversing direction for clearing jams. In an embodiment, in the off position the manually engageable portion 46 and the movable element would be located generally in the center of the recess 38, and the on and reverse positions would be on opposing lateral sides of the off position.

Generally, the construction and operation of the switch 42 for controlling the motor 18 are well known and any construction for such a switch 42 may be used. For example, instead of a mechanical switch, a sensor based switch may be used. See U.S. application Ser. No. 11/536,415, the entirety of which is incorporated herein by reference. Likewise, the presence of a main power switch may be omitted, and the switches in the feed openings may be triggered, simply by insertion of paper or discs, as discussed below.

The top cover 24 may also include another recess 50 associated with an optional switch lock 52. The switch lock 52 includes a manually engageable portion 54 that is movable by a user's hand and a locking portion (not shown). The manually engageable portion 54 is seated in the recess 50 and the locking portion (not shown) is located beneath the top wall 24. The recess 50 also has a pair of slots (not shown) on the opposing lateral sides thereof. The manually engageable portion 54 has resilient catch members (not shown) that are inserted into the slots so as to securely mount the switch lock 52 for sliding movement within the recess 50. Generally, switch lock 52 may be constructed to move the switch 42 from the on and/or reverse position to the off position as switch lock 52 moves from the releasing position to the locking position by any suitable arrangement known in the art. The switch lock is an optional feature and is not necessary. Its use is beneficial for preventing inadvertent actuation of the on/off switch. Other safety features may also be used, such as the proximity sensor or other devices as shown in U.S. Patent Publication Nos. 2006/0054724 A1, 2006/0054725 A1, and 2006/0219827 A1, the entirety of each of which is incorporated herein by reference. Again, any such device is optional and should be regarded as limiting.

Housing 14 also has a first, generally laterally extending opening 34 and a second, generally laterally extending opening 36 provided thereon. Openings 34 and 36 extend generally parallel to each other on top wall 24 and above the cutter elements 25 and 27 (respectively). Opening 34 is designed as a paper receiving opening to paper receiving path 40, and opening 36 is designed to be a disc receiving opening to disc receiving path 44, as described below. Disc receiving opening 36 is provided in a generally spaced apart relation from paper receiving opening 34. Openings 34 or 36, often referred to as throats, enable the articles being destroyed to be fed into the cutter elements 25 and 27. As can be appreciated, paper receiving opening and disc receiving opening 34, 36 are relatively narrow, which is desirable for preventing overly thick items, such as large stacks of documents or multiple discs, from being fed into cutter elements 25 and 27, which could lead to jamming. Openings 34 or 36 may have any configuration. In the preferred embodiment, as shown in FIGS. 1-2, paper receiving opening 34 is generally of longer length along the top wall when compared to disc receiving opening 36. Even more specifically, it is preferred that opening 34 is of a length to accommodate the insertion of paper of standard sizes (e.g., 8.5 inch×11 inch paper or A4 paper), and opening 36 is of a length to accommodate the insertion of optical disc structures, such as CDs or DVDs, of standard sizes (e.g., 1.2 millimeters (mm) thick, 80 mm or 120 mm diameter). For example, the length of opening 34 may be about 9 inches or greater (for accommodating 8.5×11 inches or A4 paper), and the length of opening 36 may be, for example, at least 120 millimeters (mm) or greater for accommodating standard CDs or DVDs. Also, the disc opening 36 may have a thickness, for example, that is greater than 1.2 mm, such as of at least 1.4 millimeters (mm), for permitting insertion of only one disc (or multiple discs) at a time. However, the length of either opening 34 or 36 should not be limited to the preferred embodiment. Rather, openings 34 and 36 may be of similar length on housing 14.

It should also be noted that the location of opening 36 should not be limited to the above description. Although disc receiving opening 36 is shown as being in relation to the top left side of paper receiving opening 34, opening 36 may be located in any location on housing 14. For example, opening 36 may be placed on the right, left, or in the center of housing 14, as well as above or below opening 34.

Optionally, in another embodiment, opening 36 may be designed to receive credit cards or other similar substrates.

FIG. 3 shows a detailed view of substrate destruction mechanism 16 comprising first and second rotatable shafts 20, 22 and stationary structure 30 in accordance with the preferred embodiment of the present invention. First and second rotatable shafts 20, 22 are each provided with a plurality of cutter elements 25 and 27, respectively. The cutter elements 25 and 27 are provided on each of the shafts 20, 22 such that the cutter elements on each shaft interleave with each other. In an embodiment, at least a portion of cutter elements 25 and 27 have a radial projection thereon to shred or destroy articles fed between the shafts. The radial projections preferably include cross cutting teeth 37. As known in the art, the use of cross cutting teeth on cutter elements 25, 27 allows for shredding of the paper into small chips rather than long strips. In another embodiment, the cutter elements comprise radial bumps or protrusions 47 along their periphery to aid in destroying the substrates, either alone or in cooperation with projections, such as cross cutting teeth. Further, it is envisioned in another embodiment that the cutter elements have any shape or configuration, and may be sloped with undulating surfaces to create shaped paper shreds (e.g., diamond shapes or chips). However, it should be noted that the radial profile of the projections should not be limited, and the cutter elements may include any known configuration for paper cutting. For example, in one embodiment, it is envisioned that the cutter elements may be designed for strip cutting by interleaving with one another such that they cooperate to shear paper or substrates in the feeding direction between the cutters, to thus create long strips of paper. As is well known, strip cutter elements do not have cutting teeth for transversely cutting the paper strips, unlike cross cutter elements that do.

Also shown are strippers 49 arranged between each of the cutter elements mounted on the axis of the shafts. Strippers 49 are provided to strip away the shredded paper as it is fed through the interleaving cutter elements 25 and 27. That is, the strippers 49 prevent the cut paper from winding up on the shafts during rotation. This prevents clogging of the cutting area and the mechanism 16 from jamming.

As shown, first and second rotatable shafts 20, 22 create paper receiving path 40 to accept paper that is input into paper receiving opening 34. Additionally, second shaft 22 and stationary structure 30 create disc receiving path 44 for optical discs that are input into disc receiving opening 36. Thus, second rotatable shaft 22 is a shaft that is shared for destroying both paper and optical discs. Also shown is motor 18 and sub-frame 21. Motor 18, as noted above, is an electrically powered motor that is operable in a paper mode or disc destruction mode, thus activating the corresponding shafts or shaft for rotation. That is, when motor 18 is activated, it is designed to at least rotate the shared shaft, i.e., second rotatable shaft 22, in the direction corresponding to either the paper mode or the disc destruction mode, further described with relation to FIGS. 4*a* and 4*b* below.

Substrate destruction mechanism 16 comprises stationary structure 30 as noted above. Stationary structure 30 is designed to work in cooperation with the cutter elements on a rotating shaft (i.e., cutter elements 27 on secondary shaft 22), and does not rotate or move in relation to the rotating shaft. While some relative motion between components of the stationary structure 30 and the rotating shaft 22 may be permitted, the overall structure as a whole remains stationary and does not move in cooperation with the rotating shaft 22. For example, the substantially stationary structure 30 may comprise ball bearings or beads on or within the structure (e.g., on the back of the structure, within spaces of the structure, at a mounting or attachment point, etc.) to reduce friction or aid in absorbing forces that are inflicted upon the substantially stationary structure 30 when working in cooperation with the cutters 27 of the rotating second shaft 22. Likewise, some minor movement of the stationary structure 30 may be permitted, such as through the use of spring mounts to accommodate slight play. Generally, however, the overall structure 30 is stationary.

Figure 3A:
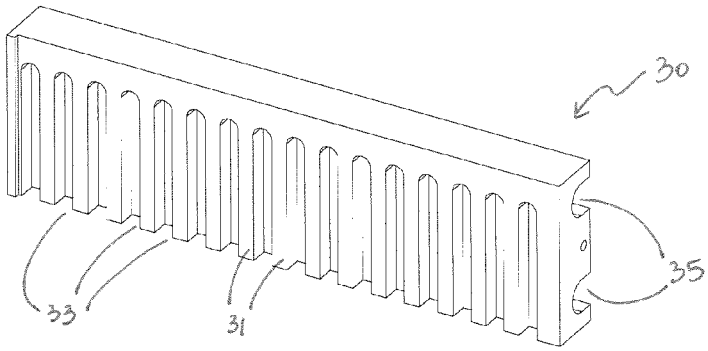
FIG. 3*a* is a detailed view of the stationary structure in accordance with the present invention.

In an embodiment, stationary structure 30 has an array of engaging members 31 with spaces 33 therebetween, as illustrated in detail in FIG. 3*a*. Spaces 33 of stationary structure 30 are arranged such that at least the radial projections are received in the spaces 33 on stationary structure 30 to interleave with engaging members 31.

Stationary structure 30 is positioned such that an optical disc fed through disc receiving opening is fed between at least a portion of the cutter elements 27 of second rotatable shaft 22 and the stationary structure 30. Preferably, stationary structure 30 is positioned below the disc receiving opening 36. In a preferred embodiment, stationary structure 30, as shown in FIG. 3, is at least the length of disc receiving opening 36. That is, stationary structure 30 may be of similar length as compared to disc receiving opening 36. Alternatively, structure 30 may also be of shorter length (e.g., half the size of the opening 36), or of longer length (e.g., the length of housing 14) when compared to opening 36.

In an embodiment, at least a portion of stationary structure 30 is mounted such that is it aligned to receive the radial projections 37 of cutter elements 27 within its spaces 33 in order to at least damage the inserted disc. Therefore, the length of structure 30 should not be limiting. In another embodiment, structure 30 may be mounted in any location behind cutting shafts 20 or 22 such that the engaging members 31 are on a tangent to the primary diameter of the cutters (e.g., the diameter of the cutter elements 27). In one embodiment, the engaging members 31 of the stationary structure 30 may be constructed such that a spacing or clearance, for example, of approximately 1 mm, is allowed between the engaging members 31 and the outer diameter of the cutter(s) 27. This ensures some penetration of the radial projections 37 (delimiting the outer diameter) into the surface of a standard 1.2 mm optical disc. Preferably, the clearance is less, and more preferably there is no clearance and the projections 37 instead are received within the spaces 33 so as to interleave with the engaging members 31.

Stationary structure 30 may be mounted using rods 45 located within the substrate destruction mechanism 16. As shown in the Figures, the stationary structure 30 may be provided with notches 35 with a corresponding shape for mounting on rods 45. Rods 45 may also provide support to the stationary structure 30.

However, it should be noted that the mounting of stationary structure 30 should not be limited to rods. Other known methods for mounting a structure securely may also be used. For example, stationary structure 30 may also be attached, either alone or in combination with rods 45, using at least one fastener (e.g., screw) to secure the structure 30 to sub-frame 21. Other alternatives for mounting the structure 30 may include: integrating rods 45 and stationary structure 30 into a solid metal machined rectangular plate with members 33 and 31 located on the plate. This configuration, for example, allows a CD throat to be placed either on the center of preferably towards one of the side of the cutting mechanism as shown in FIG. 3.

Figure 4A:
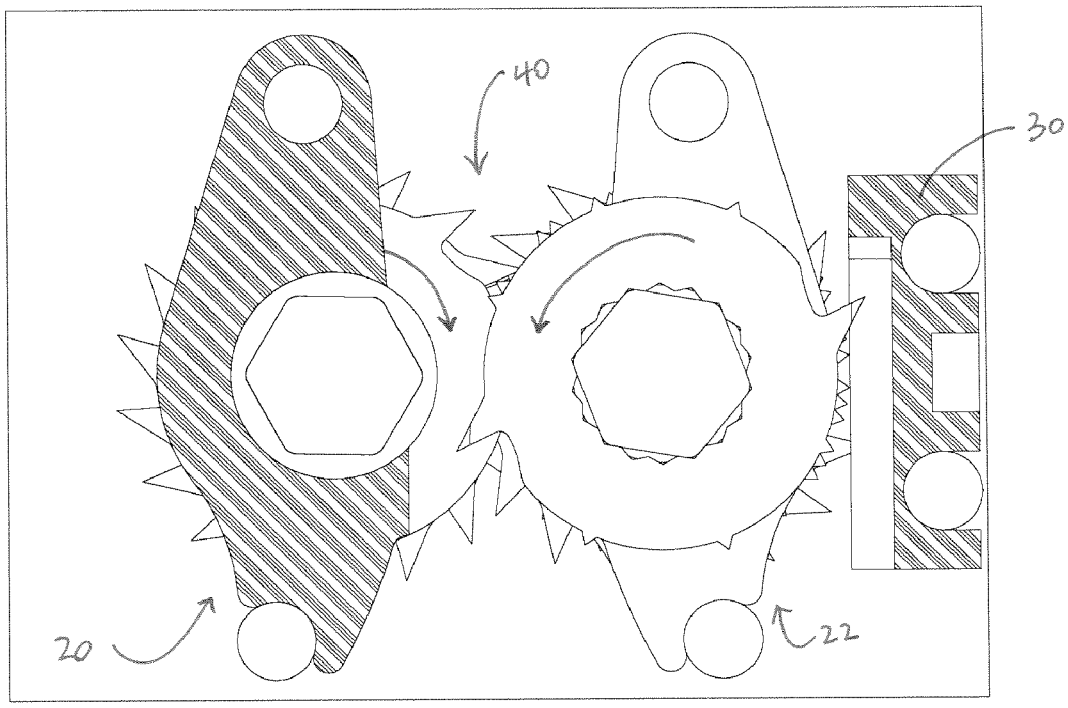
FIG. 4*a* is a cross-sectional view of the first and second rotatable shafts of FIG. 3 in use for shredding paper.
Figure 5:
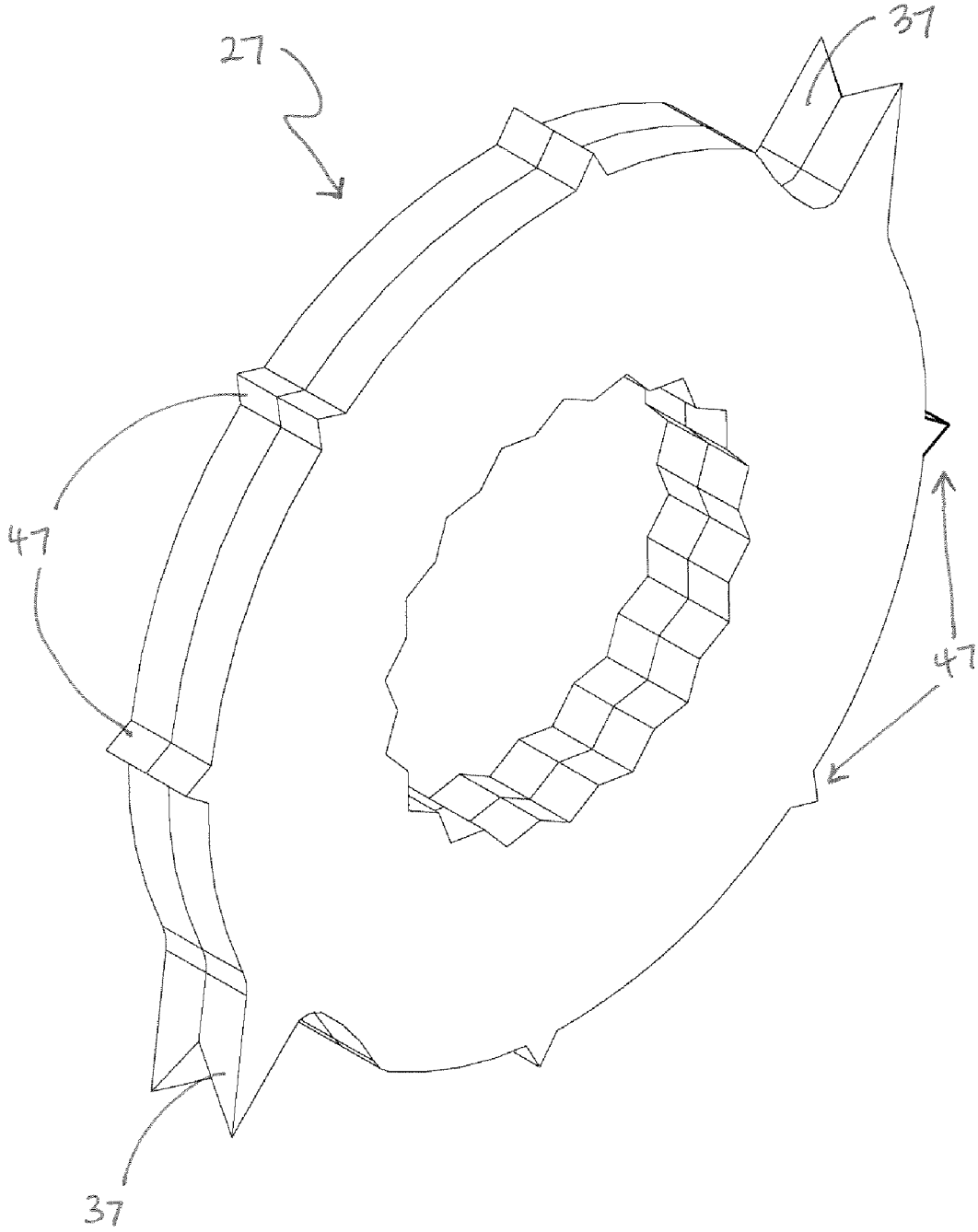
FIG. 5 is a detailed view of a cutter element to be used on a second rotatable shaft in accordance with an embodiment of the present invention.

FIG. 4*a* is a cross-sectional view of the first and second rotatable shafts 20, 22 of FIG. 3 operating in a paper shredding mode for rotating the shafts in a paper shredding direction. First and second rotatable shafts 20 and 22 are designed to be coupled to the drive system (e.g., motor 18) such that the shafts are counter-driven in respective, opposite rotational cutting directions. As shown in FIG. 4*a*, first rotatable shaft 20 is rotated in a clockwise direction and second rotatable shaft 22 is rotated in a counter-clockwise direction, such that the cutter elements 25 of first rotatable shaft 20 interleave with the cutter elements on second rotatable shaft 22. When paper is fed through paper receiving opening 34 into paper path 40, shafts 20, 22 are positioned to be rotationally counter-driven by motor 18 in a rotational cutting direction, and the paper is fed between first and second rotating shafts 20 and 22 and their corresponding cutter elements 25 and 27. As the cutter elements 25 and 27 interleave with each other, they are configured to cooperate to shred the paper fed therebetween through paper receiving opening 34, and drive such down through paper path 40 defined between the shafts 20, 22.

Figure 4B:
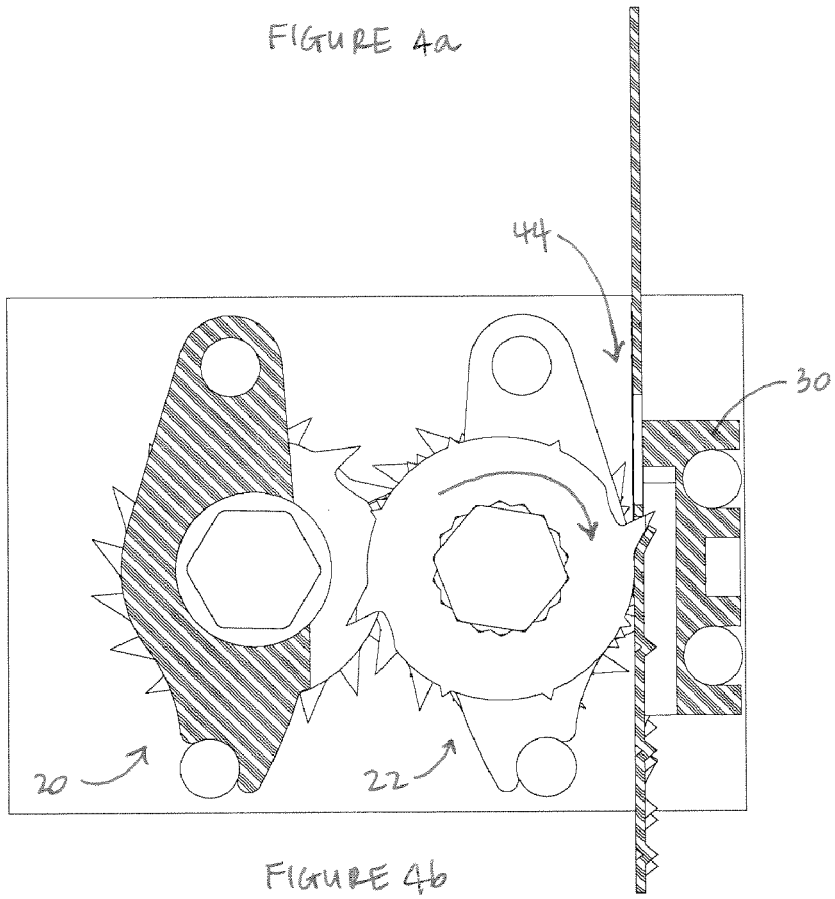
FIG. 4*b* is a cross-sectional view of the second rotatable shaft and stationary structure of FIG. 3 in use for damaging a disc.
Figure 6:
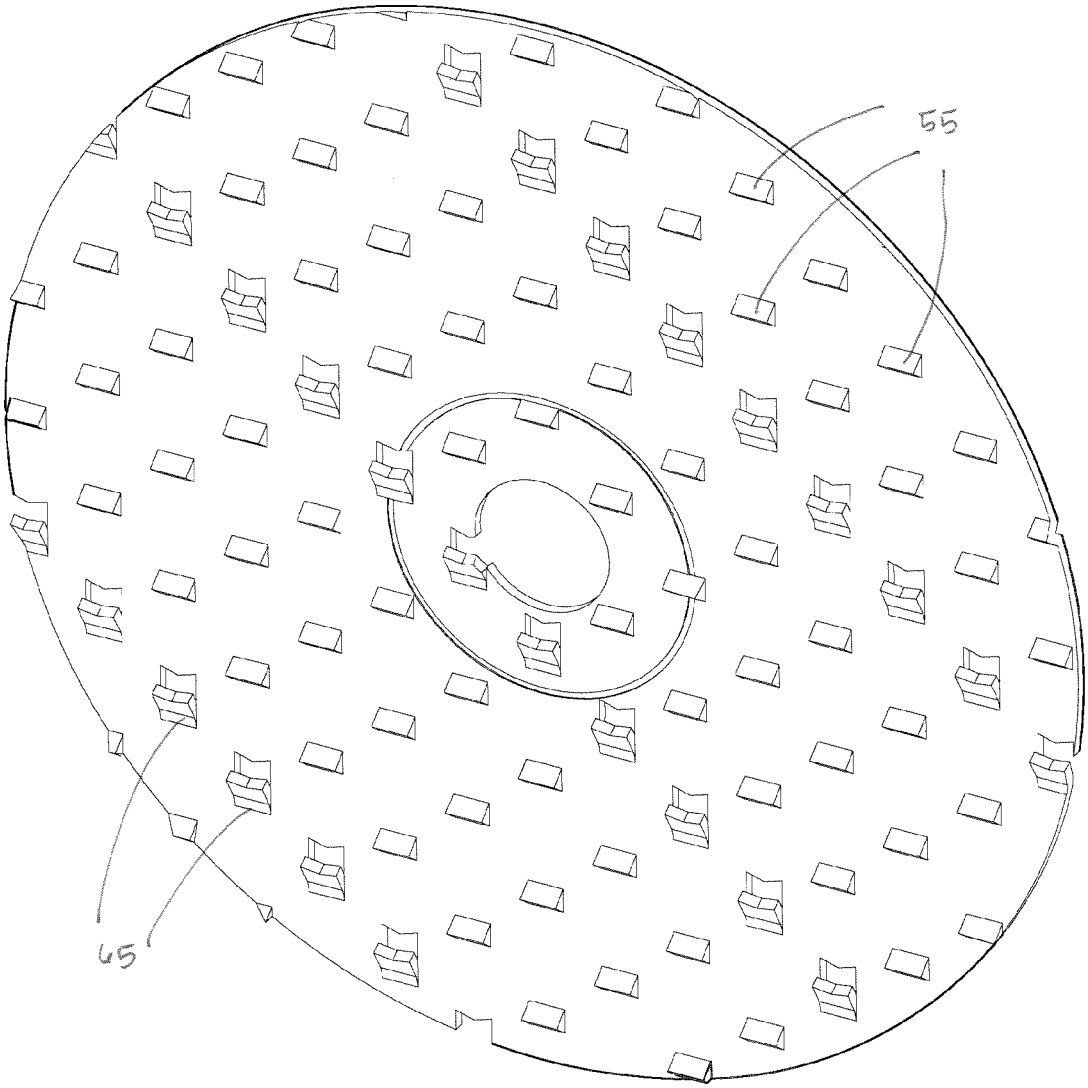
FIG. 6 illustrates an example of damage acquired by discs when fed through a disc receiving opening in a substrate destruction apparatus in accordance with the preferred embodiment of the present invention.

FIG. 4*b* is a cross-sectional view of the second rotatable shaft 22 and stationary structure 30 of FIG. 3 operating in a disc destruction mode for rotating shaft 22 in a direction for at least damaging an optical disc that is fed through disc receiving opening 36. Second rotatable shaft 22 is coupled to motor 18 which is operable in a direction opposite the paper shredding direction shown in FIG. 4*a*. As noted above, cutter elements 27 have radial projections thereon. As shown in FIG. 4*b*, second rotatable shaft 22 is rotated in a clockwise direction. When rotated in a clockwise direction, the radial projections of cutter elements 27 on rotatable shaft 22 are received in spaces 33 of stationary structure 30 to interleave with engaging members 31. When an optical disc is fed through disc receiving opening 36 and thus into disc path 44, the disc is fed between at least a portion of the cutter elements 27 of second shaft 22 and stationary structure 30, thus at least damaging the optical disc. Preferably, at least the data bearing surface of an optical disc is damaged. FIG. 6 illustrates an example of damage acquired by discs when fed through a disc receiving opening in a substrate destruction apparatus in accordance with the preferred embodiment of the present invention. By damaging the surface area of the disc, the disc is rendered unreadable and therefore is destroyed.

With respect to FIG. 4*b*, in addition to the second shaft 22 being rotated in an opposite direction, the first shaft 20 is may also be rotated in a opposite direction. That is, first shaft 20 is rotated in a counter-clockwise direction when run in a disc destruction mode. The synchronous rotation of both shafts provides a configuration may allow for a simpler gear design, for example. However, first shaft 20 does not participate in damaging the disc.

In another embodiment, the second shaft 22 rotates in the opposite direction while the first shaft remains idle.

In one embodiment, to cause the most damage to at least the surface of an optical disc, cutter elements 27 on second rotating shaft 22 are used. FIG. 5 is a detailed view of cutter element 27 used on a second rotatable shaft 22. Cutter element 27 comprises primary radial projections 37 (i.e., cross-cutting teeth) and secondary protrusions 47 (e.g., radial bumps). Primary radial projections 37 are effective in both the paper shredding and disc destruction directions and modes. In a paper shredding mode, projections 37 are driven in the paper shredding direction to cooperate and interleave with cutter elements 25 of first rotating shaft 20 to shred paper. That is, the bodies of interleaved cutter elements act in a scissors like manner to cut the paper in the feeding direction, and the projections 37, or teeth, cut the paper off into smaller chips. Projections 37 preferably take a shape to form of cross cutting teeth to cross cut paper into pieces. In a disc direction mode, projections 37 are driven via shaft 22 in a direction opposite the paper shredding direction (i.e., in a disc destruction or clockwise direction) to damage at least a portion of an optical disc, which has its opposite side against the engaging members 31. Damage to an optical disc may include scratches, cuts, depressions, holes, punches, etc. formed in the data bearing surface of the disc by the projections 37 and/or protrusions 47. Though the disc remains physically intact, the data on the destroyed optical disc is irretrievable by conventional disc scanning or data recovery services. Optionally, in another embodiment the cutter elements 27 and the engaging members 31 may be designed to shred the disc into smaller pieces.

As previously noted, the cutter elements may have any slope or configuration, and may be sloped with undulating surfaces to create diamond-shapes, chips, strips, or other shaped paper shreds. Likewise, the cutter elements may be made of one piece or multiple pieces.

To increase the amount of destroyed disc surface, at least one secondary protrusion 47 may be provided on cutter elements 27. Secondary protrusions 47 are used along with primary radial projections 37 to create a denser pattern of damage on the surface of the disc as the disc is fed between shaft 22 and stationary structure 30. Protrusions 47 may be of equal or lesser height or radial extent as compared to projections 37. In a preferred embodiment, protrusions 47 are of lesser radial extent than projections 37. Projections 37 and protrusions 47 cause damage of different depths along the disc surface. FIG. 6 shows an exemplary pattern that may be created using cutter element 27 with projections 37 and protrusions 47 as described. Shallow damage to the surface of the disc is indicated by 55 (which may be caused by protrusions 47) and deeper damage to the surface of the disc is indicated by 65 (which may be caused by projections 37).

The number of projections 37 and protrusions 47 shown in the illustrated drawings should not be limiting. Preferably at least one projection 37 is provided on cutter elements 27 to assist in shredding paper inserted through opening 34. It is envisioned, however, that two, three, or more projections may also be provided along the periphery. In another embodiment, no projections are provided along the periphery of the cutter elements, and the cutter elements are designed to work in cooperation to shear a substrate. Also, any number of protrusions may be provided on the cutter elements 27 of the second shaft 22. For example, secondary protrusions do not need to be included on the periphery of the cutter elements. However, the addition of one, two, or more secondary protrusions 47 between the projections 37 are within the scope of this invention.

Alternatively, in an embodiment, protrusions may be supplied on the engaging members 31 of the stationary structure 30 to increase the destruction pattern on the disc (e.g., scratch marks) as it is feed through disc receiving opening 36. In another embodiment, structures (e.g., blades) may replace the flat or smooth surface of the engaging members 31, for example, to cut a disk into multiple pieces or strips.

In an embodiment, stationary structure 30 may be used in cooperation with second rotatable shaft 22 to damage, cut, or shred discs into pieces or chips. In another embodiment, the structure 30 may be used in cooperation with the cutters 27 on the second rotatable shaft 22 to damage, cut, or shred discs.

In yet another embodiment, structure 30 may be designed to provide a flat support surface for the cutters 27 of second rotatable shaft 22 to work in cooperation with for damaging and destroying discs. Thus, there would be no interleaving of the cutter elements 27 in this embodiment; however, there would be a clearance between the cutter elements 27 and the surface of the structure 30.

Although second shaft 22 is described as rotating in a clockwise direction when run in a disc destruction mode, the second shaft 22 may also rotate in a counter-clockwise or paper shredding direction during disc destruction. The second shaft 22 may be used to cause damage to a substrate or for further operation during disc destruction. For example, in one embodiment, after at least the data bearing surface of an optical disc is damaged, the motor 18 is operable in a counterclockwise direction or the paper feeding direction to feed or eject the disc outwardly from the container 12, i.e., back through the disc receiving opening 36, such that the disc may be removed from the opening 36. The damaged disc may then be discarded through the downwardly facing opening 32 of the bottom receptacle 29 and into container 12.

Also envisioned in the apparatus is the use of a detector or sensor (such as an optical sensor or an electromechanical sensor) inside any of the throats or openings 34 and 36 to determine the presence of a substrate in one of the openings 34 or 36 and activate proper operation of motor 18 to rotate shafts 20 and 22. For example, an optical sensor may be used in paper receiving opening 34 and another optical sensor may be used in disc receiving opening 36 (or anywhere between the openings and the interface of cutting elements and/or the stationary structure). Upon insertion of a substrate into one of the openings, the optical sensor detects its presence, thus activating the motor 18 to rotate the necessary shaft(s). Specifically, when paper is inserted into paper receiving opening 34, the optical sensor in or beneath opening 34 detects the paper and activates motor 18 in the paper mode (as discussed above) for rotating shafts 20, 22 in a paper shredding direction to shred paper that is fed through the opening 34. Likewise, the optical sensor in or beneath disc receiving opening 36 will detect when a disc is insert into disc receiving opening 36, thus activating the motor 18 in the disc destruction mode.

In another embodiment, the use of a detector or sensor inside or near the throat or opening 36 or disc receiving path 44 may also be used to activate the motor 18 in either the disc destruction direction or the paper shredding direction during the disc destruction mode. For example, to eject a disc outwardly from the container 12 after the disc is at least partially damaged while rotating the second shaft 22 in a disc destruction direction, a sensor, such as an optical or electromechanical sensor, may be used to detect at least a portion of a substrate or disc in the opening 36 or path 44, and, based upon a result of the sensing of the substrate, the motor 18 may be operated and rotate the shaft 22 in the paper shredding direction.

In an alternate embodiment, the motor 18 may be operable to rotate the shaft 22 in the disc destruction direction for a predetermined amount of time. After the predetermined amount of time, the motor 18 may be operable or configured to rotate the shaft 22 in the paper shredding direction (e.g., such that an optical disc may be ejected from the opening 36 or disc receiving path 44). Any known timing device may be used in cooperation with the operation of the motor and shafts for any amount of time, and should not be limiting.

In yet another embodiment, the sensor and timing device may work in cooperation with each other, and may be configured to operate the motor in either direction. For example, the sensor may activate the motor, and, after a predetermined amount of time, the motor may be configured to operate in a reverse direction (i.e., paper shredding direction). In another example, the sensor may detect a portion of a substrate and thus activate the timing device such that the motor is operable in a reverse direction (i.e., paper shredding direction) after a predetermined amount of time. However, the above examples are not intended to be limiting in any way.

Alternatively, an on/off switch may be used in place of optical sensors for rotating the necessary shafts. An on/off switch may have three modes or positions, such as the OFF position (no power is delivered from motor to the shaft(s)), a PAPER position (the motor operable in a paper mode, as described above, so as to rotate the first and second rotating shafts 20, 22 in relation to each other such that their cutting elements interleave with each other to shred paper), and the DISC position (the motor is operable in a disc destruction mode, as also described above, to rotate second rotatable shaft 22 in a direction opposite the paper shredding direction and in relation to stationary structure 30 such that projections of shaft 22 interleave with spaces 33 of stationary structure 30 to damage or destroy discs). The on/off switch would be used to activate only the proper shafts needed for destroying the inserted substrate chosen by the user. As an alternative, this switch may also be used in conjunction with sensors in or beneath the throat openings, thus allowing the switch to be used to place the shredder in a ready state for one type of operation or the other, and then the motor can be activated upon insertion of the substrate into the appropriate opening. Likewise, a standard on/off switch could be used, with the on position providing a ready state, and the motor being activated by insertion of a substrate being detected by one of the sensors.

The above mechanism may be implemented in all cross cut machines including models that are unable to destroy discs in the primary cutting mechanism. They may also be used in strip cutting machines.

In any situation where the direction of the second shaft is changed, this change can be affected by a clutch mechanism changing the gearing path, or any other mechanical approach. Thus, reversal of motor rotation is not the only way to control the shaft.

It should also be noted that housing 14 is designed specifically for use with container 12, and it is intended to sell them together. The upper peripheral edge 60 of the container 12 defines an upwardly facing opening 62 and a seat on which shredder 10 is removably mounted. Included on the seat are upwardly facing recesses 66 that are defined by walls extending laterally outwardly from the upper edge of the container 12. The walls defining the recesses 66 are molded integrally from plastic with the container 12, but may be provided as separate structures and formed from any other material. Housing 14 is fitted to sit in opening 62 by aligning with recesses 16 in container 12.

While the principles of the invention have been made clear in the illustrative embodiments set forth above, it will be apparent to those skilled in the art that various modifications may be made to the structure, arrangement, proportion, elements, materials, and components used in the practice of the invention.

It will thus be seen that the objects of this invention have been fully and effectively accomplished. It will be realized, however, that the foregoing preferred specific embodiments have been shown and described for the purpose of illustrating the functional and structural principles of this invention and are subject to change without departure from such principles. Therefore, this invention includes all modifications encompassed within the spirit and scope of the following claims.

What is claimed is:

1. A substrate destruction apparatus for destruction of at least paper and optical discs, comprising:

a housing;

a paper receiving opening provided on the housing;

a disc receiving opening provided on the housing in spaced apart relation from the paper receiving opening;

a substrate destruction mechanism provided in the housing and comprising first and second rotatable shafts each provided with a plurality of cutter elements, the cutter elements being provided on the shafts such that the cutter elements on each shaft interleave with the cutter elements on the other shaft, the shafts and cutter elements being positioned such that paper fed through the paper receiving opening of the housing is fed between the shafts and the cutter elements;

the substrate destruction mechanism further comprising an electrically powered motor for rotating the shafts, the shafts being rotatable by the motor in a paper shredding direction wherein the cutter elements shred the paper fed through the paper receiving opening;

the substrate destruction mechanism further comprising a stationary structure, the stationary structure and the second shaft being positioned adjacent one another such that at least a portion of the cutter elements on the second shaft interleave with the stationary structure, the stationary structure and the second shaft and the cutter elements thereof being positioned such that an optical disc fed through the disc receiving opening is fed between at least the portion of the cutter elements of the second shaft and the stationary structure; and the second shaft being rotatable by the motor in a disc destruction direction opposite the paper shredding direction, thus at least damaging an optical disc fed through the disc receiving opening between the cutter elements and the stationary structure.

2. A substrate destruction apparatus according to claim 1, wherein the motor is operable in a paper mode to rotate the shafts in the paper shredding direction, and is operable in a disc destruction mode to rotate the second shaft in the disc destruction direction, the disc destruction mode being the reverse of the paper mode.

3. A substrate destruction apparatus according to claim 1, wherein the stationary structure comprises an array of engaging members with spaces therebetween, and wherein the stationary structure and the second shaft are arranged such that the portion of the cutter elements on the second shaft are received in the spaces on the stationary structure to interleave with the engaging members.

4. A substrate destruction apparatus according to claim 3, wherein the cutter elements on the second shaft have radial projections on at least a portion thereof, and wherein the stationary structure and the second shaft are arranged such that at least the radial projections are received in the spaces on the stationary structure to interleave with the engaging members.

5. A substrate destruction apparatus according to claim 4, wherein damaging the optical disc is caused by the disc being fed through the disc receiving opening between the radial projections and the engaging members.

6. A substrate destruction apparatus according to claim 4, wherein the cutter elements include cross-cut teeth for cross-cutting paper fed between the shafts and the cutter elements during rotation of the shafts in the paper cutting direction;

wherein the radial projections on said at least a portion of the cutter elements of the second shaft include at least the cross-cut teeth on said at least a portion of the cutter elements.

7. A substrate destruction apparatus according to claim 4, wherein the radial projections on said least a portion of the cutter elements of the second shaft include protrusions positioned circumferentially between the cross-cut teeth of those cutter elements, the protrusions having a lesser radial extent than the cross-cut teeth.

8. A substrate destruction apparatus according to claim 4, wherein at least damaging an optical disc comprises scratches, cuts, depressions, holes, punches, or shredding into pieces.

9. A substrate destruction apparatus according to claim 7, wherein the cross-cut teeth and protrusions cause damage of different depths along the disc surface.

10. A substrate destruction apparatus according to claim 2, wherein the operation and direction of the motor is determined upon detection of a substrate in a paper receiving or disc receiving opening.

11. A substrate destruction apparatus according to claim 10, wherein an optical sensor or electromechanical sensor is provided in the paper receiving opening and in the disc receiving opening to detect the substrate.

12. A substrate destruction apparatus according to claim 2, wherein the operation of the motor is determined upon activation of an on/off switch, the switch movable from an off position to a paper position or a disc position, wherein when the switch is placed in the paper mode position the motor is operable in the paper mode, and when the switch is placed in the disc mode position the motor is operable in the disc destruction mode.

13. A substrate destruction apparatus according to claim 1, wherein the paper receiving opening and disc receiving opening are parallel to each other.

14. A substrate destruction apparatus according to claim 1, wherein the paper receiving opening is generally of longer length as compared to the disc receiving opening.

15. A substrate destruction apparatus according to claim 1, wherein the stationary structure is of similar length as compared to the disc receiving opening.

16. A substrate destruction apparatus according to claim 1, wherein the apparatus further comprises a waste container disposed beneath the housing to receive destroyed substrates.

17. A substrate destruction apparatus according to claim 1, wherein the motor is operable in a paper mode to rotate the shafts in the paper shredding direction, and is operable in a disc destruction mode to rotate the second shaft in the disc destruction direction, the second shaft being operable to rotate in the paper shredding direction during the disc destruction mode.

18. A substrate destruction apparatus according to claim. 17, wherein after damaging the optical disc, the motor is operable to rotate at least the second shaft in the paper shredding direction such that the damaged optical disc is fed outwardly of said disc receiving opening between the cutter elements of the second shaft and the stationary structure.

19. A substrate destruction apparatus according to claim 18, wherein an optical sensor or electromechanical sensor is provided near the disc receiving opening to operate the motor in the paper shredding direction.

20. A substrate destruction apparatus according to claim 18, wherein the motor is operable in the disc destruction direction for a predetermined amount of time.

21. A substrate destruction apparatus according to claim 20, wherein the motor is operable in the paper shredding direction after the predetermined amount of time.

22. A substrate destruction apparatus according to claim 1, wherein said substantially stationary structure comprises bearings for reducing friction or forces inflicted thereon while cooperating with the cutter elements of the second shaft.

* * * * *

UNITED STATES PATENT AND TRADEMARK OFFICE

CERTIFICATE OF CORRECTION

PATENT NO. : 7,677,483 B2
APPLICATION NO. : 11/696576
DATED : March 16, 2010
INVENTOR(S) : Dmitry Romanovich et al.

It is certified that error appears in the above-identified patent and that said Letters Patent is hereby corrected as shown below:

In column 13, Claim 7, lines 28-33 should read:

7. A substrate destruction apparatus according to claim 6, wherein the radial projections on said least a portion of the cutter elements of the second shaft include protrusions positioned circumferentially between the cross-cut teeth of those cutter elements, the protrusions having a lesser radial extent than the cross-cut teeth.

Signed and Sealed this

Fifth Day of October, 2010

David J. Kappos

David J. Kappos
*Director of the United States Patent and Trademark Office*